United States Patent [19]

Kafka et al.

[11] 4,403,799

[45] Sep. 13, 1983

[54] FLUSH HASP HAVING FOLDABLE, UPSTANDING LATCHING PORTION, AND OPTIONALLY USABLE WITH PADLOCK

[75] Inventors: Robert S. Kafka, Maitland; Charles F. Kafka, Bradenton, both of Fla.

[73] Assignee: Meacham Marine Products, Inc., Sarasota, Fla.

[21] Appl. No.: 175,651

[22] Filed: Aug. 6, 1980

[51] Int. Cl.[3] ..... E05C 19/08

[52] U.S. Cl. ..... 292/285

[58] Field of Search ..... 292/281–286; 70/13

[56] References Cited

U.S. PATENT DOCUMENTS

| | | | |
|---|---|---|---|
| 150,564 | 5/1874 | Gilmore | 292/285 |
| 418,505 | 12/1889 | Descalzo et al. | 70/13 |
| 546,916 | 9/1895 | Crawford | 70/13 |
| 564,515 | 7/1896 | Glover | 70/13 |
| 1,017,709 | 2/1912 | Untch | 292/285 |
| 1,248,078 | 11/1917 | Chubbic | 292/104 |
| 1,508,384 | 9/1924 | Drake | 292/285 |
| 2,067,255 | 1/1937 | Bittorf | 292/281 |
| 2,180,306 | 11/1939 | Hull | 292/281 X |
| 2,468,575 | 4/1949 | Sweaney et al. | 292/205 |

*Primary Examiner*—Richard E. Moore

*Attorney, Agent, or Firm*—Julian C. Renfro

[57] ABSTRACT

A novel flush hasp for use in conjunction with a boat hatch, door or the like, the hasp having a base portion adapted to be mounted on a boat deck or door jamb adjacent the hatch or door. This base portion is utilized in conjunction with a movable hasp member adapted to be mounted on the hatch or door and movable therewith toward or away from engagement with the base portion. The base portion is provided with a locking means rotatable between locking and release positions, whereas the movable hasp member is provided with an aperture designed when adjacent the base member to receive the locking means and closely interact therewith. In accordance with the first two embodiments of this invention, the base portion has locking means in the form of a closed loop that may be rotated while extending through the aperture of the movable hasp member so as to tightly engage the movable portion of the hasp and thus achieve a latching of the hatch or door in the closed position. At such time the closed loop may either be in a folded down position wherein the likelihood of a passenger on the boat tripping is minimized, or it may be utilized in an upstanding position so that the shackle of a padlock may be passed through the loop in order to achieve a locking of the hatch. Another embodiment of this invention involves the use of a rotatable member having at least one lug on its upper surface, which lug on occasion may enter the aperture in the movable hasp portion. Locking means, preferably key operated, is provided so that movement of the lug to the release position can be prevented except when it is desired to open the hatch.

5 Claims, 13 Drawing Figures

FLUSH HASP HAVING FOLDABLE, UPSTANDING LATCHING PORTION, AND OPTIONALLY USABLE WITH PADLOCK

RELATIONSHIP TO PREVIOUS INVENTION

This invention bears some similarity to our copending U.S. patent application Ser. No. 075,654, filed Sept. 14, 1979, and entitled "FLUSH HASP HAVING DEPENDENT LATCHING PORTION, AND OPTIONALLY USABLE WITH PADLOCK", now U.S. Pat. No. 4,316,626, issued Feb. 23, 1982.

BACKGROUND OF THE INVENTION

It is well known that many types of hasps have been provided for use in connection with the securing of doors, gates, tool chests, cellar doors, cabinets and the like in order that these items may be secured and even padlocked to maintain them on occasion in the closed position.

Hasps have also been used on the deck hatches of boats in order that they may be padlocked to prevent theft of boat cushions, fishing equipment and the like from underdeck storage space when the boat owner is away, and the boat has been left moored to a dock, residing on its trailer, or the like. Unfortunately, most hasps have a fixed, upstanding loop residing ⅝" or more above the deck, designed to receive a padlock, with a large slotted portion of the hasp being designed to interfit with the loop. When the hasp is in its closed position, and a padlock put through the loop, the hatch cannot be opened. In addition, the hasps are ordinarily attached to the deck by a hinged heel plate screwed into the deck from above, typically creating a ½" projection at the hinge.

A fixed, upstanding loop ordinarily does not cause inconvenience when mounted on a door or gate, but when the loop is mounted either on a hatch, or the deck of the boat adjacent the hatch, the loop poses a safety threat in that the loop may well cause a person to trip, or if he or she steps on the loop wearing anything except hard-soled shoes, the upstanding loop may cause pain if not injury to the foot of the boater. Frequent breakage of the loop portion occurs, which is a major problem in deck mounted hasps.

It was for the purpose of overcoming the disadvantages attendent the use of ordinary hasps employed in the locking of hatches of a boat that we evolved several embodiments of a novel flush-hasp device, each of which represents a distinct advantage over the prior art.

SUMMARY OF THE INVENTION

In accordance with this invention, we have provided a novel flush hasp suitable for use in conjunction with a boat hatch, door, or the like. This device is ideal in instances where considerable strength of the latching device is desirable, and where there may be not perfect alignment of the hatch or door with its respective deck or door jamb.

In accordance with this invention, the hasp has a base portion equipped with a rotatable member, with such base portion typically being mounted on the deck or door jamb closely adjacent the edge of the hatch or door.

Utilized in operative relation with the base portion is a movable hasp portion having an elongate aperture therein, which movable hasp portion is secured to the hatch or door so as to be movable therewith either toward or away from the base portion.

In order that either latching or locking of the hatch or door may be accomplished, the base portion is provided with means designed to enter the aperture of the movable hasp member, so that latter member may be firmly engaged. In the first two embodiments of this invention this means is in the form of a closed loop which may be rotated after the movable hasp member has been engaged, so as to achieve a latching of the hatch in the closed position. A suitable spring means is utilized in the construction of the base member, so that rattling or vibration of the hatch will be minimized.

It is important to note that the closed loop may be moved to a folded down position, in which position it is held by the spring means. When in this position, the likelihood of a boat passenger tripping over the hasp is minimized.

When it is desired to lock the hatch when this embodiment of our invention is being utilized, the closed loop is moved to the upstanding position, and the shackle of a padlock is passed therethrough. By maintaining a padlock in the closed loop portion, the hatch or door may be made quite secure.

A somewhat different embodiment of this invention involves the movable portion of the base member being equipped with a lug designed on occasion to enter the aperture in the movable hasp member, when in the correct orientation with respect thereto. Locking means, typically key operated, controls the rotation of this part of the base member so as to prevent movement of the lug to the release position except when it is desired to open the hatch.

It is thus to be seen that in all of these embodiments, the movable hasp portion is able to be of minimum thickness, and the below deck dimension of the base portion is able to be relatively small.

It is therefore a primary object of this invention to provide a flush hasp of economical construction having a foldable, upstanding latching portion that is optionally usable with a padlock.

It is another object of this invention to provide a hasp of minimum thickness that is of strong yet economical construction, and which combines the attributes of safety, strength, and attractive appearance.

It is another object of our invention to provide a padlockable hasp for use in connection with the locking of a deck hatch of a boat, or of a door or other aperture, wherein strength as well as safety and serviceability are important considerations.

It is another object of our invention to provide a hasp ideal for maritime use wherein a disparity between the level of a hatch or door with respect to its respective deck or door jamb can be readily accommodated.

It is yet another object of our invention to provide a flush hasp of sturdy and economical construction usable in a number of different relationships wherein the hasp may be locked with a padlock when such is appropriate, but wherein the hatch may be easily and securely latched when locking is not required.

It is yet still another object of our invention to provide a hasp suitable for maritime use wherein the vertical height of the hasp is minimized, thus permitting a great range of placement positions on a boat or other craft.

These and other objects, features and advantages may become more apparent as the description proceeds.

DETAILED DESCRIPTION

Figure 1:
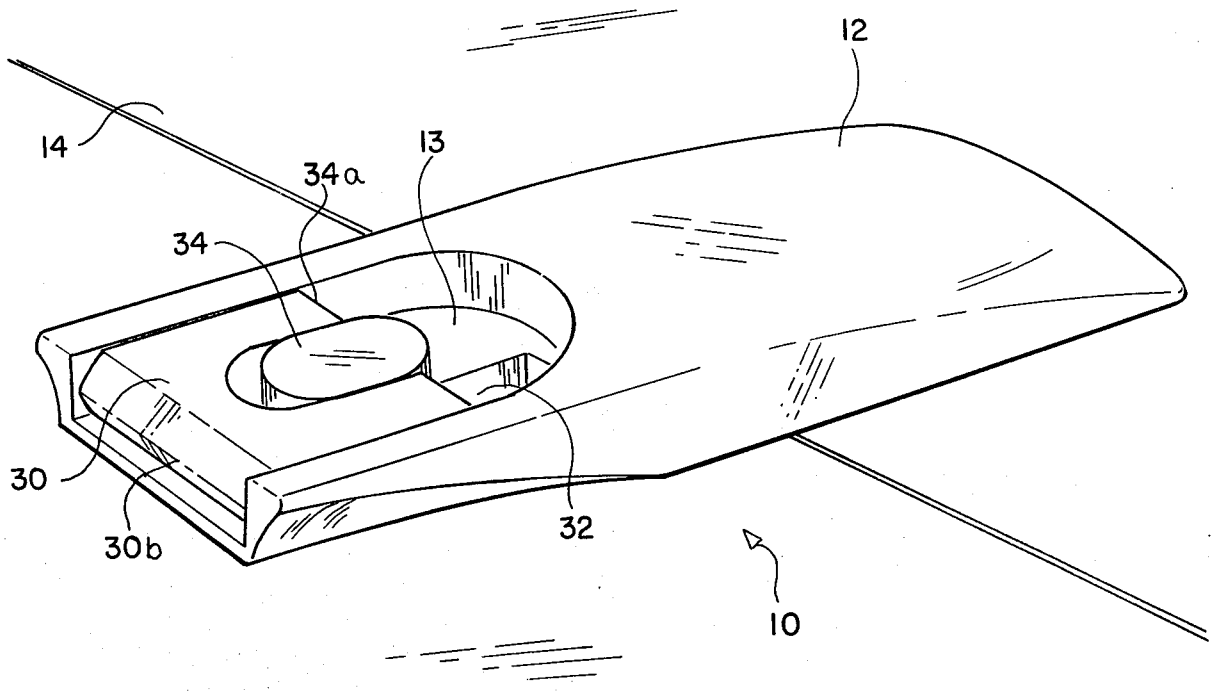
FIG. 1 is a perspective view of a primary embodiment of our novel flush hasp as installed on the hatch of a boat, shown here in the latched position.

In FIG. 1 we have illustrated a first embodiment of our novel flush hasp 10 having a foldable, upstanding latching portion. In this embodiment the principal hasp member 12 is rigidly mounted upon the edge of a hatch 14 of a boat or the like. Preferably, the hasp is secured to the hatch by the use of a bolt 16 integral with the underside of the member 12, upon which bolt a nut 18 is employed, in the manner illustrated in FIG. 3. Undesirable movement of the member 12 with respect to the hatch may be minimized by providing serrations on the underside of member 12, where it contacts the hatch 14.

As will be noted from a study of the several figures of drawing associated with this embodiment, the hasp portion 12 is arranged to move with the hatch 14 as the latter is moved away from a closed position, which warrants our referring on occasion to the member 12 as the movable hasp member.

The member 12 moves relative to, and in aligned relation with, base portion 20, latter typically being mounted on the deck 24 immediately adjacent the edge of the hatch 14. The base portion is equipped with a threaded elongate portion 26 upon which a nut 28 may be employed in order to secure the base portion firmly to the deck; note FIG. 3.

Figure 3:
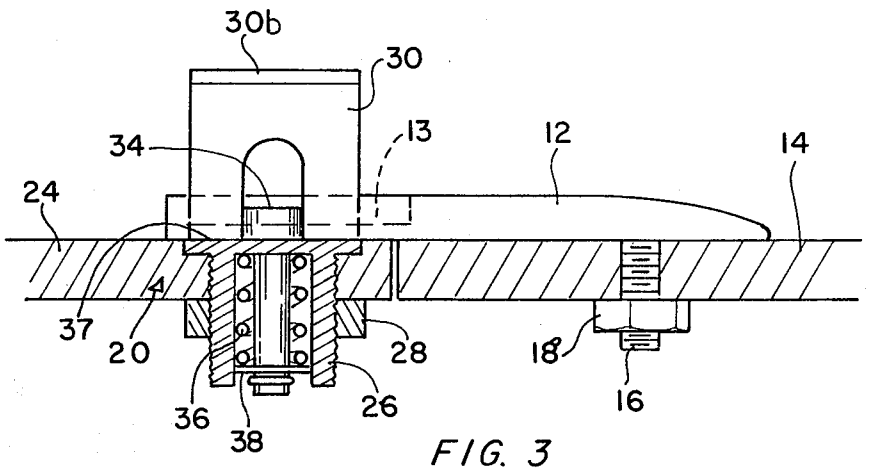
FIG. 3 is a view much like FIG. 2 except that a side elevational view is shown, and the below-deck portion of the base member has been sectioned so as to reveal internal construction.
Figure 2:
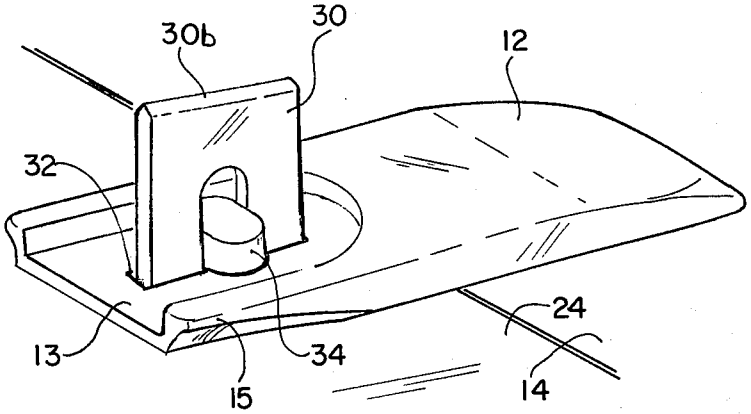
FIG. 2 is a view to a smaller scale of the hatch shown in FIG. 1, wherein a part of the base portion of the hasp has been moved into an upstanding position.

With reference to FIGS. 2 and 3, it is to be noted that the base portion 20 is equipped with a movable portion, which in this instance principally comprises a closed loop 30. When in the orientation indicated in FIG. 2, the loop 30 may reside in an elongate aperture 32 in the part of member 12 extending beyond the hatch. When in this orientation, the loop portion permits the hatch to be readily opened and closed without hinderence.

The closed loop portion 30 is rotatably mounted upon the upper end of a rotatable central member 34 that is movable for a limited vertical extent in member 20, with member 34 being approximately the same length as elongate member 26. Disposed around the member 34 is a compression spring 36 serving to bias the closed loop portion downwardly such that its lower edge 30*a* is normally in contact with the upper portion of the base member 20. Consequently, upon the principal hasp member 12 being moved down over the closed loop 30 such that the loop passes through the aperture 32 of the member 12, a slight upward pull of the loop portion 30 is necessary before the loop portion 30 can be rotated to the transverse position illustrated in FIGS. 1 and 4, wherein the hatch is effectively latched. In the position depicted in FIG. 4, the base portion 30*a* of the loop 30 is in contact with counterbored portion 13, and the spring 36 is compressed somewhat. Not only does the downward bias on the member 30 prevent the hatch from rattling while the boat is underway, but also it tends to hold the loop portion 30 either in the erect position of FIGS. 2 and 3, or else in the flattened position shown in FIG. 1, in which it resides in the counterbored portion 13 and presents no obstacle over which the boater or his guests can trip.

Referring back to FIG. 1, it will there be noted that we have configured the upper edge portion 30*b* of the loop 30 so as to facilitate the user readily engaging the loop member preparatory to moving it from the flattened position, to the position in which it can be rotated into alignment with the aperture 32 of the principal hasp member 12.

Somewhat similarly, we have configured the outer edges of the member 12 in the manner shown in FIGS. 1 and 2 so as to present a surface or edge 15 readily engageable by the user's fingers when he or she is interested in raising the movable hasp member away from the closed position.

Figure 5:
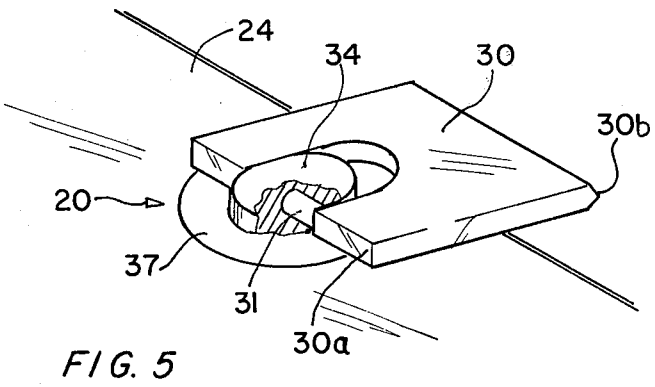
FIG. 5 is a view of the closed loop member, with a part thereof being sectioned in order to reveal internal construction.

FIGS. 3 and 5 reveal other details, including the preferred configuration of the loop member 30 in this embodiment, and the metal, washer-like member 37 that may be formed atop the threaded portion 26 in order to present an appropriate surface to be contacted by the base 30*a* of the loop member when the principal hasp member 12 has moved away from the vicinity of the base member 20. It will also be noted in FIG. 3 that the upper end of compression spring 36 contacts the underside of member 37, and the lower end of the spring 36 is secured to the lower end of member 34, such as by a spring clip 38.

Figure 4:
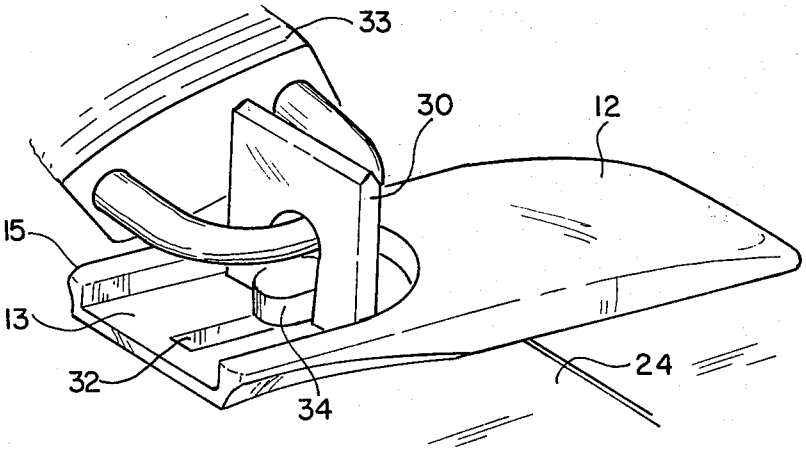
FIG. 4 is a perspective view generally similar to FIG. 2, with the shackle of a padlock having been passed through the upstanding closed loop portion of the base member in order to accomplish a locking of the hatch.

As will be seen by referring to FIG. 4, if it is desired to lock the hatch rather than merely latching it, such may be accomplished by passing the shackle of a padlock 33 through the loop 30.

A previous point is made more apparent in FIG. 5, wherein the hatch has been opened and the loop portion 30 is shown in a laid over position so as to clearly illustrate its flat base portion 30*a*. This figure reveals that the lower portion of the loop member 30 is equipped with inwardly turned fingers 31 that rotatably engage appropriate apertures in the sides of the somewhat enlarged upper portion of member 34. Because the latter member is downwardly biased by spring 36 in the manner shown in FIG. 3, the member 30 will tend to remain stable in either the erect position, or the laid over position, depending on how it is positioned in a given instance. This is because the flat base portion 30*a* meets the essentially flat sides of the member 30 at approximately a right angle, and the member 30 cannot be stably maintained on the rather pointed edge representing the intersection of these surfaces. Rather, it is only when either the base portion 30*a* or the sides of member 30 are in contact with the member 37 that the member 30 will be disposed in the aforementioned stable position.

Figure 6:
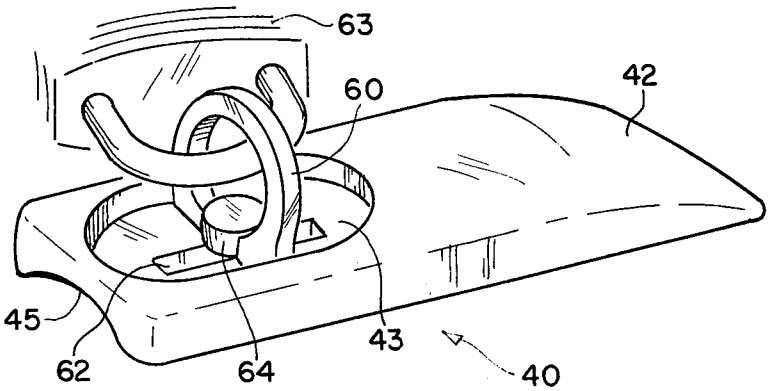
FIG. 6 is a perspective view of a somewhat different embodiment of this invention, wherein a modified closed loop portion is utilized, and such closed loop is disposed in the upstanding position in order to receive the shackle of the padlock.
Figure 8:
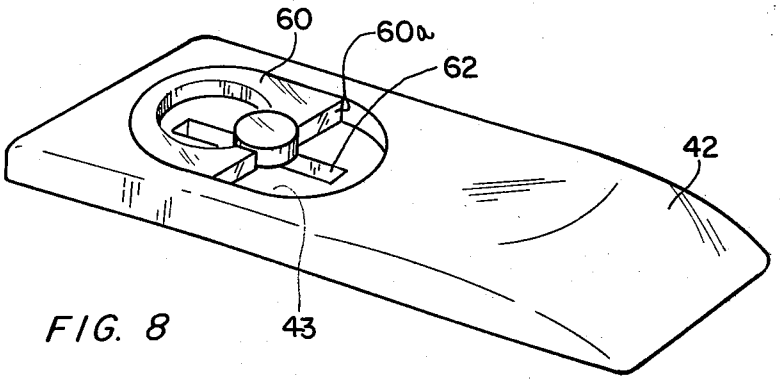
FIG. 8 is a perspective view wherein the closed loop has been moved to a flush latching position in order that the likelihood of someone tripping over the hasp will be minimized.

Turning to FIG. 6 and the figures associated therewith, it will there be seen that the hasp embodiment 40 rather closely resembles the previous embodiment in that the principal hasp member 42 contains an elongate aperture 62. However, in this instance the counterbore 43 is oval rather than being open, with the result that the closed loop 60 associated with base portion 50 is able when in its laid over position, to reside entirely within the couterbore, as revealed in FIG. 8.

As before, the principal hasp member is secured to the hatch 44 by means of a bolt 46 upon which is located a nut 48. By keeping the nut sufficiently tight, undesirable motion of the member 42 with respect to the hatch 44 can be prevented, but in a manner similar to that previously mentioned, serrations may be utilized on the portion of the member 42 in contact with the hatch in order to further minimize the possibility of undesirable movement.

The base portion 50 includes an elongate threaded portion 56 extending through a hole in deck 54, with a nut 58 being threaded onto portion 56 in order to hold the base portion in the desired location. Disposed inside the hollow portion 56 is a center member 64, that is vertically movable for a limited extent. As revealed by these several related figures, closed loop 60 is pivotally secured to the upper part of central member 64, with this latter member being biased downwardly by a compression spring 66 in order to minimize hatch vibration, and to cause the loop 60 to lie flat when it is not in use. The spring 66 is disposed inside member 56, extends around the lower portion of member 64, and is retained in operative position by member 68.

Figure 7:
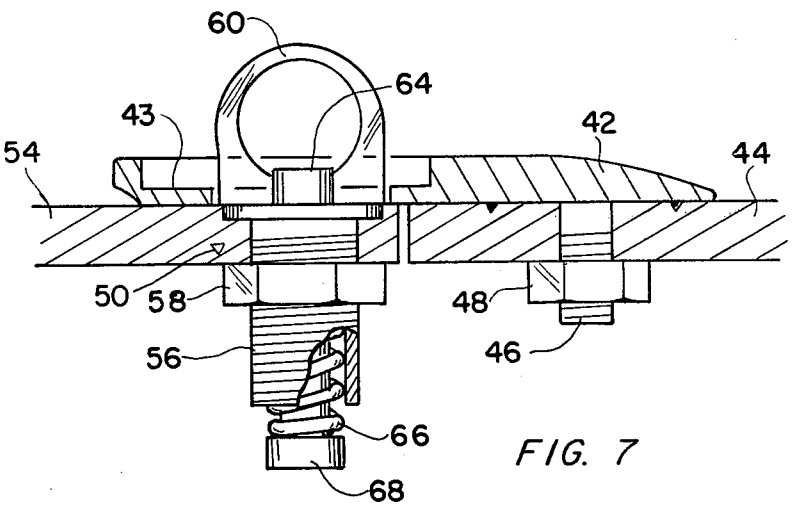
FIG. 7 is a side elevational view of the embodiment of FIG. 6, wherein the components have been sectionalized in order to reveal internal construction.
Figure 9:
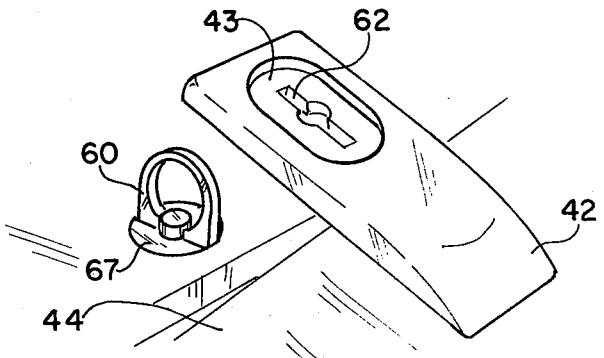
FIG. 9 is a view generally similar to FIG. 8 but to a smaller scale, with the movable hasp member having been moved away from the base member.

As will be obvious from a study of these related figures, when the loop 60 is in the upright position illustrated in FIG. 7, the hatch may be opened and closed freely, inasmuch as the loop 60 is in alignment with the aperture 62. Note FIG. 9 in this regard. On the other hand, when the loop has been lifted slightly and then rotated so as to cause its base to contact the counterbored portion 43 in the manner shown in FIG. 6, the hatch is secured in the latched position.

If the boater wishes to lock the hasp while it is in the position shown in FIG. 6, he need only pass the shackle of a padlock 63 through the loop.

Figure 10:
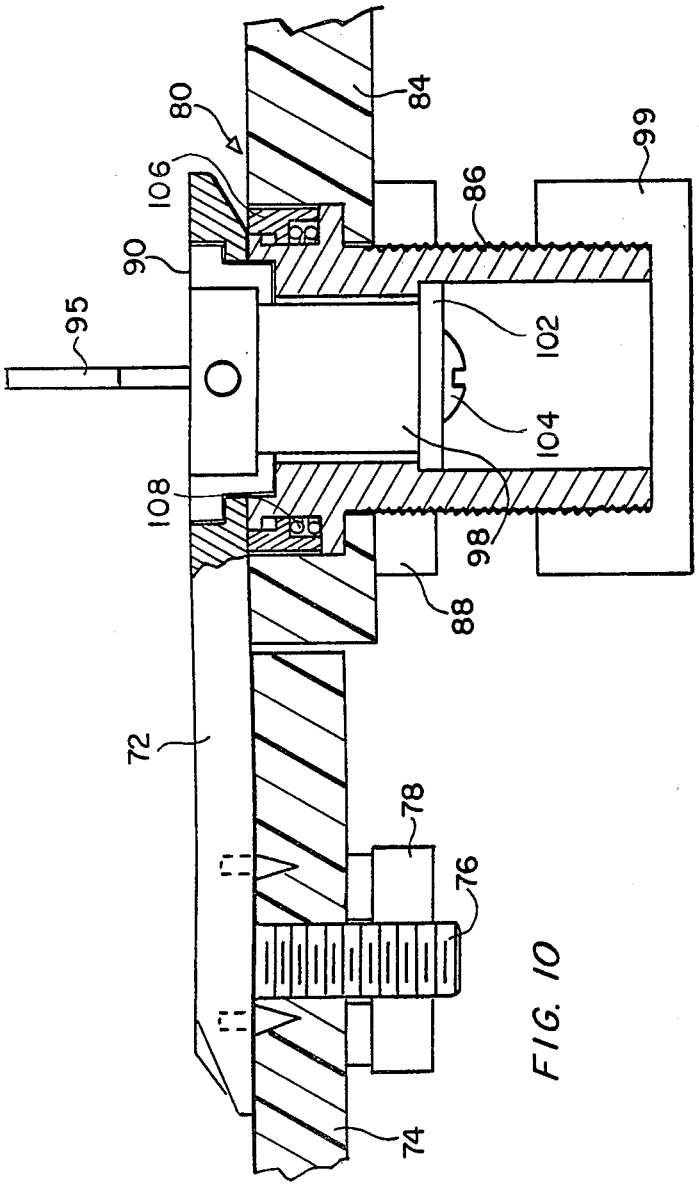
FIG. 10 is a side elevational view of another embodiment of our invention, wherein may of the components have been sectionalized so as to reveal internal construction.

Turning to FIG. 10, it there will be noted that we have provided still another embodiment of this invention, involving a principal hasp member 72 firmly attached to the edge of hatch 74, such as by a bolt 76. The bolt is preferably welded to the underside of member 72, and a nut 78 is threaded onto the bolt in order to enable the hasp to be clamped tightly to the hatch.

As will be observed from a study of these drawings, the principal hasp portion 72 moves with the hatch 74 as the latter is moved away from the closed position, which warrants our referring to the member 72 on occasion as the movable hasp member.

The member 72 moves relative to, and in aligned relation with, a base portion 80, the latter typically being mounted on deck 84 immediately adjacent the edge of the hatch 74. The base portion 80 is equipped with a threaded elongate portion 86 upon which a nut 88 may be employed in order to secure the base portion to the deck.

Figure 10A:
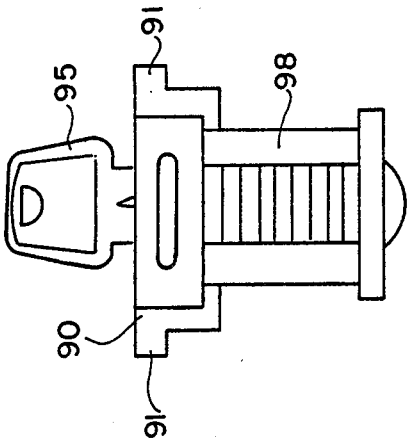
FIG. 10*a* is a fragmentary view revealing a key and lock of the type that may be utilized in the base portion of the device of FIG. 10.

The base portion 80, secured to deck 84, is provided at its upper end with a movable portion 90 equipped with one or more lugs 91. Typically, a pair of lugs are utilized, disposed as shown in FIGS. 10*a* and 11 on the periphery of the movable portion 90. These lugs are adapted, when the member 90 has been rotated, to enter respective apertures 92 in the movable hasp member 72; note the use of a pair of apertures in FIG. 11*a*. When lugs are spaced 180° apart, the apertures are likewise spaced. Quite obviously, we are not limited to two lugs, and for example, three lugs and three appropriately spaced apertures may be used, or even one lug may be employed.

Figure 11A:
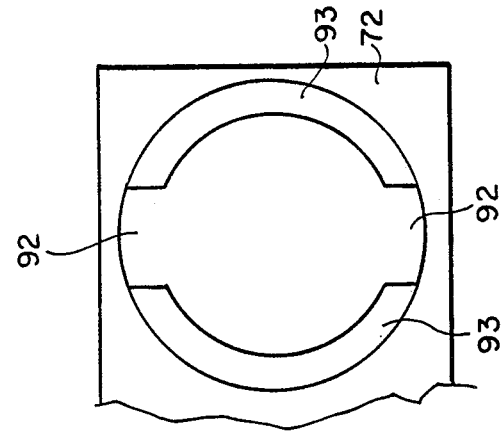
FIG. 11*a* is a fragmentary view of the end of the movable hasp member, revealing the configuration of the aperture in order that it may be engaged on occasion by the lug or lugs of the rotatable base member.
Figure 11:
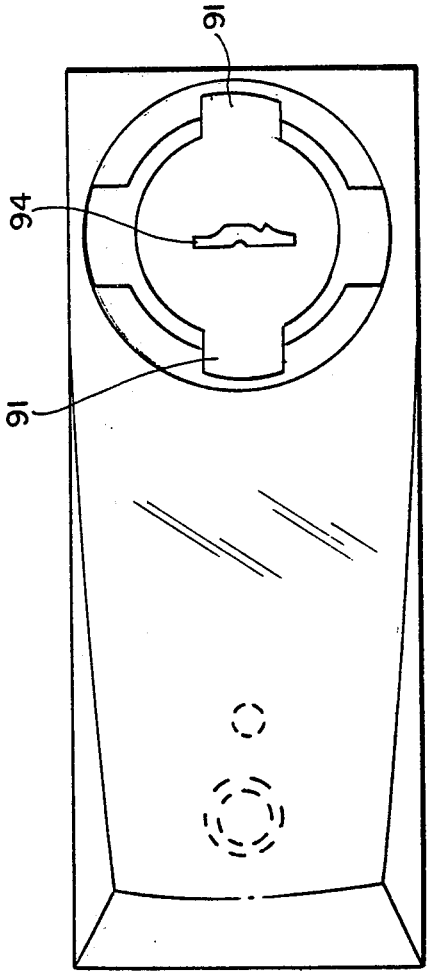
FIG. 11 is a top view of the movable hasp member in accordance with the embodiment of FIG. 10, wherein locking is achieved by rotation of a portion of the base member with respect to the movable hasp member.

In the manner illustrated in FIG. 11*a*, we prefer to counterbore the inner periphery of the large opening of the member 72, extending between the pair of apertures 92. The counterbored portions 93 enable the lugs 91 on the rotatable number 90 to move freely between the locking and the unlocking positions, in the general manner shown in FIG. 11.

The movable portion 90 is preferably equipped with a centrally disposed keyhole 94, in which is adapted to be received a key 95. A cylinder lock 98 is utilized in connection with this embodiment such that only when the key has been inserted in the keyhole and received properly in the cylinder lock may the lugs 91 be moved toward or away from the position in alignment with the apertures 92 of the movable hasp member 92. Removal of the key from the cylinder lock while the lugs are in a locking orientation prevents the member 90 being rotated by hand into the unlocked position.

The cylinder lock 98 is held in place in the interior of the elongate member 86 by means of a plate 102 that is held against the bottom of member 98 by means of a screw or bolt 104. The periphery of the plate 102 is in contact with an internal shoulder of the member 86. As revealed in FIG. 10, the rotary member 90 on the upper end of the lock 98, and the plate 102 on the lower end, prevent undesirable vertical displacement of the lock. Closure 99 may be threaded onto the bottom of the portion 86 to prevent the entry of foreign material.

Vibration of the hatch and hasp are minimized by utilizing a ring shaped member 106 that is biased by compression spring 108 into abutting relation with the underside of member 72 in the vicinity of the apertures 92.

In our previously identified co-pending patent application Ser. No. 075,654 filed Sept. 14, 1979, we described and illustrated hasp embodiments wherein some of the movable hasp members were secured directly to the hatch or door, whereas in other instances, the movable hasp member was affixed by a hinge to the hatch or door. Quite obviously, the use of a hingedly affixed hasp is equally applicable to the present invention, and we hereby incorporate by reference into the present application, all of the teachings of our co-pending application.

We claim:

1. A flush hasp especially adapted for marine use, said hasp having a base portion, and a portion movable toward and away from engagement with said base portion, said movable hasp portion having an aperture therein, and said base portion having a rotatable member adapted to enter said aperture when said movable hasp portion has been moved into contact with said base portion, said rotatable member adapted to be manually rotatable between a position aligned with said aperture, in which engagement and disengagement of said portions is readily permitted, and a latched position in which said rotatable member serves to inhibit removal of said movable hasp member from contact with said base portion, and locking means for preventing on occasion, said rotatable member from being moved away from a motion-inhibiting position, said rotatable member including a closed loop designed to receive the shackle member of a padlock, said closed loop being mounted so as to be readily moved into a relatively flat, non-protruding position when a padlock is not being used therewith, in order to lessen the likelihood of someone tripping thereover.

2. The flush hasp as defined in claim 1 in which a portion of said movable hasp portion is recessed to receive said closed loop when it is disposed in the flat position.

3. A flush hasp especially adapted for marine use, said hasp having a base portion, and a portion movable toward and away from engagement with said base portion, said movable hasp portion having an aperture therein, and said base portion having a rotatable member adapted to enter said aperture when said movable hasp portion has been moved into contact with said base portion, said rotatable member adapted to be manually rotatable between a position aligned with said aperture, in which engagement and disengagement of said portions is readily permitted, and a latched position in which said rotatable member serves to inhibit removal of said movable hasp member from contact with said base portion, and locking means for preventing on occasion, said rotatable member from being moved away from a motion-inhibiting position, said rotatable member including a closed loop designed to receive the shackle member of a padlock, and spring bias means operatively associated with the mounting of said closed loop such that said closed loop maintains a closely fitting relationship to said movable hasp portion after the rotatable member has been turned to a motion-inhibiting position.

4. In a hasp having a base portion, and a portion movable toward and away from engagement with said base portion, said movable portion having an aperture therein, and said base portion having a rotatable member adapted on occasion to enter said aperture, said rotatable member adapted to be manually rotatable between a position aligned with said aperture, in which engagement and disengagement of said portions is readily permitted, and a latching position in which said rotatable member is in an inhibiting relationship thereto, and locking means for preventing on occasion, said rotatable member from being moved away from the motion-inhibiting position, said rotatable member including a closed loop designed to receive the shackle member of a padlock, and spring bias means associated with the mounting portion of said closed loop such that said closed loop maintains a closely fitting relationship to said movable portion after the rotatable member has been turned to a motion inhibiting position.

5. The hasp as defined in claim 4 in which said closed loop may be moved to a folded over position when not being used with a padlock.

* * * * *